US008487552B2

(12) United States Patent
Watanabe et al.

(10) Patent No.: US 8,487,552 B2
(45) Date of Patent: Jul. 16, 2013

(54) LIGHTING CONTROLLING METHOD, LIGHTING APPARATUS AND LIGHTING SYSTEM

(75) Inventors: Takuya Watanabe, Kawasakishi (JP); Namjin Kim, Seoul (KR); Hyunha Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/228,587

(22) Filed: Sep. 9, 2011

(65) Prior Publication Data

US 2012/0319607 A1 Dec. 20, 2012

(30) Foreign Application Priority Data

Jun. 15, 2011 (KR) ..... 10-2011-0057818

(51) Int. Cl.
*H05B 37/02* (2006.01)

(52) U.S. Cl.
USPC ..... 315/307; 315/209 R; 315/291

(58) Field of Classification Search
USPC ..... 315/209 R, 224, 225, 246, 247, 276, 315/278, 291, 307
See application file for complete search history.

(56) References Cited

U.S. PATENT DOCUMENTS

| | | | | |
|---|---|---|---|---|
| 7,609,008 | B1 * | 10/2009 | Kohler | 315/307 |
| 7,658,510 | B2 * | 2/2010 | Russell | 362/249.02 |
| 2004/0004446 | A1 | 1/2004 | Liu | 315/224 |
| 2007/0290625 | A1 | 12/2007 | He et al. | 315/274 |
| 2009/0195190 | A1 | 8/2009 | Fong et al. | 315/297 |
| 2012/0032605 | A1 * | 2/2012 | Peng | 315/219 |

FOREIGN PATENT DOCUMENTS

| | | | |
|---|---|---|---|
| KR | 10-0425421 | B1 | 3/2004 |
| KR | 10-0544265 | B1 | 1/2006 |
| KR | 10-0569717 | B1 | 4/2006 |
| KR | 10-2009-0124215 | A | 12/2009 |
| KR | 10-2010-0134945 | A | 12/2010 |
| KR | 10-2011-0019245 | A | 2/2011 |
| KR | 10-1040833 | B1 | 6/2011 |
| WO | WO 2010/035155 | A2 | 4/2010 |
| WO | WO 2011/045057 | A1 | 4/2011 |

OTHER PUBLICATIONS

Korean Notice of Allowance dated Sep. 1, 2011 issued in Application No. 10-2011-0057818 (with English Translation).
Korean Office Action dated Aug. 2, 2011 issued in Application No. 10-2011-0057818 (with English Translation).
European Search Report dated Sep. 25, 2012 issued in Application No. 11 18 1731.

* cited by examiner

*Primary Examiner* — Jimmy Vu
(74) *Attorney, Agent, or Firm* — KED & Associates, LLP

(57) ABSTRACT

A lighting apparatus, a lighting system and a lighting control method are disclosed. The lighting apparatus includes an LED module, a heat sink for emitting heat generated from the LED module, a rectifier for rectifying an input commercial AC power, a transformer including a main coil and an auxiliary coil to transform the rectified power, and an electronic module for biasing a current used to drive the LED module based on the input voltage transported via the auxiliary coil.

10 Claims, 11 Drawing Sheets

LIGHTING CONTROLLING METHOD, LIGHTING APPARATUS AND LIGHTING SYSTEM

CROSS REFERENCE TO RELATED APPLICATION

This application claims the benefit of the Patent Korean Application No. 10-2011-0057818, filed on Jun. 15, 2011, which is hereby incorporated by reference as if fully set forth herein.

BACKGROUND OF THE DISCLOSURE

1. Field of the Disclosure

The present invention relates to a lighting control method, a lighting apparatus and a lighting system.

2. Discussion of the Related Art

In the lighting industry, studies and researches have been still under development on a lighting source, a light emission type and a driving method of a lighting apparatus.

A conventional lighting system generally uses a lighting source such as an incandescent lamp, an electric discharge lamp and a fluorescent lamp for a household, landscape and industrial usage. Here, a resistive lighting source including the incandescent lamp has a low efficiency and a heat generation problem. The electric discharge lamp has problems of a high price and a high voltage. The fluorescent lamp has an environmental disadvantage of mercury usage.

To overcome disadvantages of those lighting sources, there have been increasing interests in a light emitting diode (LED) having advantages of light-emitting efficiency, color variety and design autonomy. There have been increasing studies and researches on a lighting system including the LED as lighting source.

The LED is a semiconductor element which emits a light when a voltage is applied thereto forwardly. The LED has a long usage life, low power consumption, with electrical, optical and physical properties which are proper to mass production and the LED has been rapidly replacing the incandescent lamps and fluorescent lamps.

Generally, a lighting apparatus uses commercial Alternative Current (AC) power lines as electricity supply source. As a result, a lighting apparatus having the LED as lighting source has to be operated by the commercial AC power lines, too.

A conventional lighting apparatus having the conventional incandescent lamp as lighting source controls luminosity of the incandescent lamp, namely, dimming by using a dimmer. A phase control dimmer using a triode AC switch (e.g., TRIAC) is generally used as the dimmer. The phase control dimmer uses the TRIAC to be controlled and switched on at a predetermined phase angle of a voltage waveform of the commercial AC power and it converts the on-phase angle to control dimming freely.

Relating to that, the phase control dimmer is used to control the dimming of the LED lighting apparatus. Here, the LED lighting apparatus generally rectifies the input commercial AC power and controls a smoothing capacitor with a high capacity to suppress variation of the power voltage after that. As a result, even when the phase control dimmer lowers the input commercial AC power to control dimming, the smoothing capacitor stores sufficient electric charge for the LED to be luminous and it controls currents of the LED to be uniform. Because of that, the dimming required by the phase control dimmer is not controlled. In other words, the dimming of the LED is not lowered in the LED lighting apparatus as much as the dimming controlled by the phase control modulator, compared with the incandescent lamp lighting apparatus.

SUMMARY OF THE DISCLOSURE

The present invention is directed to a lighting control method, a lighting apparatus performing the lighting control method and a lighting system including the lighting apparatus.

An object of the present invention is to provide a lighting system which includes a dimmer as lighting control means to control lighting.

Another object of the present invention is to provide a lighting control method, a lighting apparatus and a lighting system including the lighting apparatus, which can reduce flicker generated by input voltages in a lighting control process and which can reduce power consumption.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a lighting apparatus includes a light emitting diode (LED) module, a heat sink configured to emit heat from the LED module, a rectifier configured to rectify an input alternative current (AC) power, a transformer including a first coil and a second coil to transform the rectified power and an electronic module configured to bias a current for operating the LED module based on an input power transformed from the second coil.

In another aspect of the present invention, a method of controlling a light in a lighting system including a lighting apparatus having a light emitting module (LED) and a dimmer, the method includes controlling and outputting a phase of an AC power input via the dimmer, rectifying the output AC power into a DC power, determining whether the rectified input power is lowered to be in a predetermined range or lower, transforming the rectified input power, biasing a current used to operate the LED module based on the transformed power and radiating a light by operating the LED module.

According to the present invention, there may be following effects.

First, the dimmer can be operated normally even in the lighting system using the LED as lighting source. Because of that, lighting may be controlled by using the dimmer effectively.

Second, flickering which might be generated in the lighting apparatus by input voltages may be reduced effectively.

Third, power consumption of the lighting apparatus generated by the input voltages may be reduced effectively.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Figure 1:
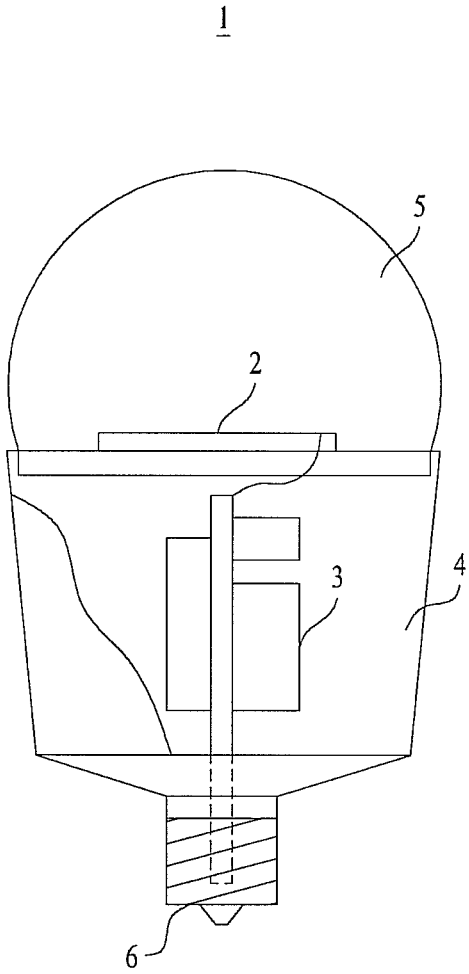
FIG. 1 is a diagram illustrating a perspective view illustrating a lighting apparatus according to an embodiment of the present invention.

Embodiments of the present invention will be described in reference to the accompanying drawings.

Suffixes of elements used in following description "module" and "part" are given, considering convenience of description used in the specification. The "module" and "part" may be used combinedly.

Furthermore, embodiments of the present invention will be described in detail in reference to the accompanying drawings and contents disclosed in the drawings and the present invention is not limited to the embodiments.

Terminologies used in the present disclosure are selected from common expressions which are well known and used currently, and the terminologies may be varied by intensions of those who skilled in the art the present invention pertain to, practices or emergence of new technologies. In a specific case, there may be terminologies selected by the applicant of the present disclosure on his or her own discretion and meanings of corresponding terminologies will be described in the detailed description. As a result, the terminologies used in the present disclosure have to be understood based on substantial meanings possessed thereby and contents of the disclosure, not based on simple titles of the terminologies.

Reference will now be made in detail to the specific embodiments of the present invention, examples of which are illustrated in the accompanying drawings. Wherever possible, the same reference numbers will be used throughout the drawings to refer to the same or like parts.

It will be understood that expressions including ordinal numbers such as "first" and "second" are used to refer to various elements. The elements are not limited to the ordinal numbers and the expressions are used only for distinguish one element from the others.

As follows, a lighting control method, a lighting apparatus implanting the lighting control method and a lighting system including the lighting apparatus will be described in reference to the accompanying drawings.

Especially, there will be described in detail a lighting control method, a lighting apparatus and a lighting system including the lighting apparatus, which can reduce flicker generated by input voltages in a lighting control process and which can reduce power consumption.

"A lighting apparatus" described in the present disclosure commonly refers to an apparatus which can emit a light generated from a light emitting diode (LED) used as lighting source, not from the conventional incandescent or fluorescent lamp. Especially, the lighting apparatus according to the present invention may include a variety of types including a bulb type, a flat type, and parabolic aluminized reflector (PAR) type. As follows, the bulb type will be embodied to realize the present invention to help the present invention to be understood.

In addition, "dimmer or light controller" used in the present disclosure includes all of lighting control means for controlling the lighting apparatus. Especially, a TRIAC phase control dimmer is embodied to realize the device which controls dimming of the lighting apparatus according to the present invention.

Here, the scope of the present invention should not be limited by the embodiments or embodiments which will be described and but by the appended claims of the disclosure.

FIG. 1 is a perspective view illustrating a lighting apparatus according to an embodiment of the present invention.

As mentioned above, the lighting apparatus 1 according to the embodiment of the present invention uses the LED with low power consumption, long usage life and eco-friendliness as lighting source currently, instead of the conventional incandescent lamp.

In reference to FIG. 1, the lighting apparatus 1 according to the present invention includes a LED module 2 having a plurality of LED chips, a driving circuit 3 for controlling driving of the LED module 2, a case 4 for accommodating the LED module 2 and the driving circuit 3, to radiate heat generated from the LED module 2, a cover 5 for protecting the LED module 2 and for transmitting a light irradiated from the LED module 2, and a base 6. Here, the lighting apparatus 1 according to this embodiment of the present invention may further include a heat sink (not shown) to absorb and sink the heat generated from the LED module 2. The heat sink may be arranged in a predetermined region, for example, between the case 4 and the LED module 2 to radiate the heat generated from the LED module 2 more effectively.

The LED module 2 is formed on a metal based printed circuit board (PCB) or ceramic substrate, with an insulation layer, and the plurality of the LED chips may be mounted on the LED module 2. Such the LED module 2 selects the number of serial and/or parallel connections of the LED chips properly to set driving voltages and/or driving currents.

The driving circuit 3 is connected with the base 6 and it transports an external power supplied via the base 6 to the LED module 2 via a lead wire, to control the driving of the LED module 2. For example, the external power may be a commercial power line, especially a commercial Alternative Current (AC) power and it may be 110V or 220V. Here, the present invention is not limited thereto and all of commercial AC power lines used domestically or internationally may be applicable to the present invention. The driving circuit 3 rectifies the input AC power, to convert it into a Direct Current (DC) power. After that, the driving circuit 3 transforms the DC power to be proper to the driving of the LED module 2 and it supplies the transformed power to the LED module 2.

As follows will be described various configurations and embodiments of a lighting system including the lighting apparatus 1 described in reference to FIG. 1 according to the present invention.

A lighting apparatus according to an embodiment of the present invention includes a LED module, a heat sink for emitting heat generated from the LED module, a rectifier for rectifying an input commercial AC power, a transformer including a main coil and an auxiliary coil to transform the rectified power, and an electronic module for biasing a current used to drive the LED module based on the input voltage transported via the auxiliary coil. The lighting apparatus may further include a switching circuit for repeating on and off based on a predetermined frequency and a duty ratio and for adjusting a duty ratio, and a damper part for decreasing the output based on the input voltage automatically.

Here, the electronic module may bias the current to be varied in reverse proportion to an AC input voltage or to heighten a limited value of a voltage used to drive the LED module.

The electronic module biases the current used to driving the LED module based on one of an average of waveforms rectifying the AC input voltage, a peak voltage and a phase angle at which a dimmer controlling dimming of the lighting apparatus is on.

When the AC input voltage is lowered, the lighting apparatus sets and controls the on-time of the switching circuit to be reduced below a range in which interruption of AC line currents is not generated. The damper part connects the power line after the rectifying with the ground to lower the output.

When the AC input voltage is lowered, the lighting apparatus controls the damper part to connect the rectified power line with the ground to lower the output and it controls the switching circuit not to adjust the duty ratio of the one-time.

The duty ratio of the switching circuit is set and controlled for the consumed currents of the LED driving circuit in a low input voltage not to be a lower limit or lower at which the dimmer is driven normally. When the LED at the low input voltage is too bright than a desired value, a bias circuit is added at the output of the LED driving circuit to bias the currents of the LED. Currents are varied in reverse proportion to the AC input voltage at the bias circuit.

The lighting apparatus may be an LED driving apparatus which drives the LED after receiving an input AC voltage to control a total capacity of a smoothing capacitor after rectifying to be 1 uF or lower and to control a SW element of the LED driving circuit to be a critical conduction mode (CRM) of a fixed on-time. Because of that, when the AC input voltage is lowered, the control for reducing the on-time of the switching circuit is not performed and a damper circuit configured of resistance and a serial circuit of a capacitor may be connected between the power line after the rectification with the ground.

Alternatively, the lighting apparatus may be an LED driving apparatus which drives the LED by receiving the AC input voltage to control the total capacity of the smoothing capacitor after the rectification to be 1 uF or less and to control the SW element of the LED driving circuit to be in the CRM of the fixed on-time. Because of that, when the AC input voltage is lowered, the on-time of the switching circuit is set and controlled to be reduced in a range in which interruption of AC line currents is not generated. In addition, the damper circuit configured of resistance and a serial circuit of a capacitor may be connected with the power line after the rectification and the ground.

Figure 2:
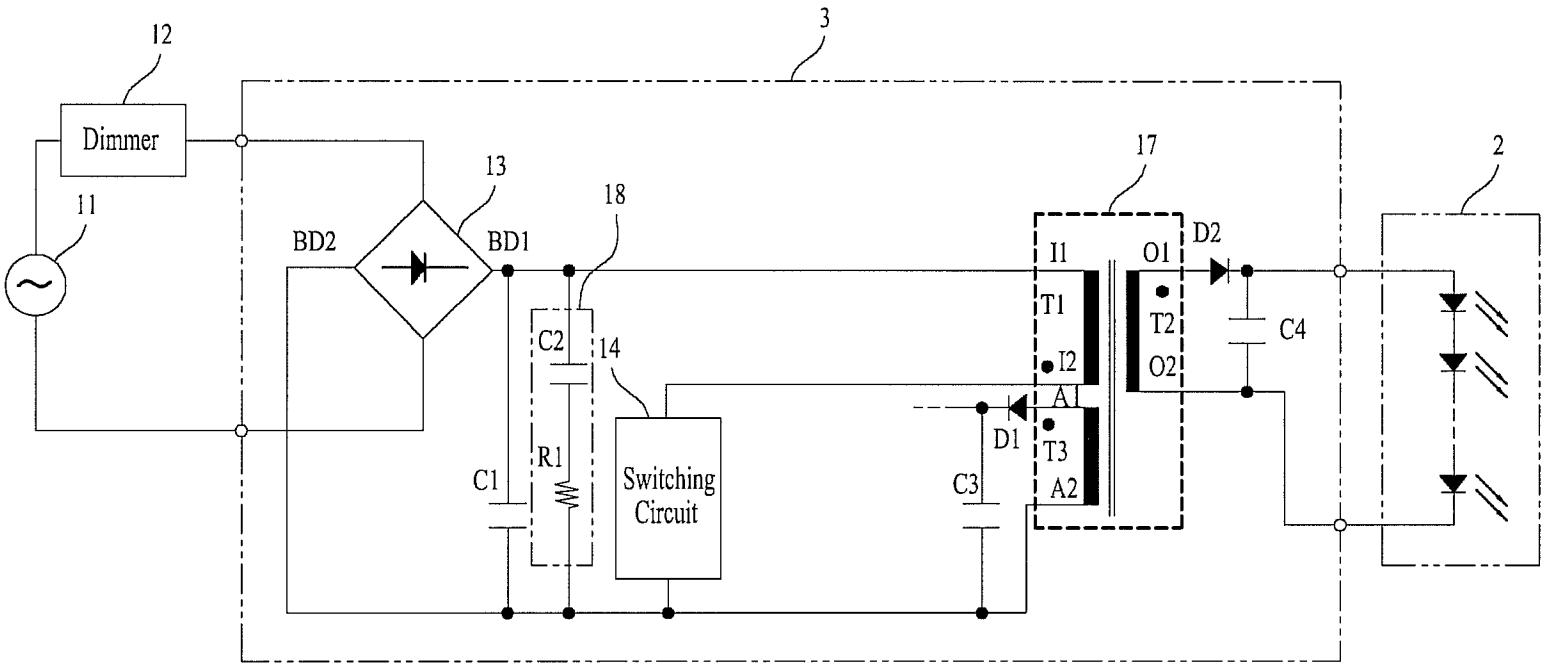
FIG. 2 is a diagram illustrating a lighting system according to an embodiment of the present invention.

FIG. 2 is a diagram illustrating a lighting system according to an embodiment of the present invention.

In reference to FIG. 2, the lighting system according to the embodiment of the present invention includes a power part 11, a lighting apparatus 2 and 3 and a dimmer 12 for controlling the lighting apparatus 2 and 3.

Here, it is embodied that the lighting apparatus 2 and 3 of the lighting system is connected with the power part 11 supplying the commercial AC power from the external dimmer 12.

As mentioned above, the power part 11 is employed to supply the commercial AC power to the lighting apparatus 2 and 3.

The dimmer 12 controls a conduction phase angle of the commercial AC power supplied by the power part 11 by using TRIAC which is an AC switching element. Because of that, dimming of the LED module 3 is controlled. In other words, when a user operates a controller (not shown) of the dimmer, the dimmer 12 controls the TRIAC based on the operational degree to control the conduction phase angle and an effective voltage of the output is varied by the conduction phase angle.

FIG. 2 illustrates only the LED module 2 and the driving circuit 3 provided in the lighting apparatus 1 shown in FIG. 1 for convenience sake.

As mentioned above, the LED module 2 includes at least one LED chip connected in serial and/or parallel. Here, FIG. 2 illustrates the LED module 2 having the plurality of the LED chips connected in serial.

The driving circuit 3 receives the commercial AC power varied by the conduction phase angle controlled by the dimmer 12 and it supplies a power used to drive the LED module located at a rear terminal.

For that, the driving circuit 3 may include a rectifier 13 and a transformer 17, for example. Here, the driving circuit 3 may further include at least one of a switching circuit 14 and a damper circuit 18, if necessary.

In reference to FIG. 2, each element of the driving circuit 3 and a function of each element will be described in detail.

When the commercial AC power supplied by the power part 11 is controlled firstly and input as mentioned above, the rectifier 13 rectifies the input commercial AC power to convert it into a DC power. At this time, the rectifying may include half-wave rectification and full-wave rectification. Here, the full-wave rectification with better efficiency is embodied.

The DC power rectified from the AC power by the rectifier 13 is input to at least one of a first coil terminal I1 of the transformer 17, a capacitor (C1) and a damper circuit 18.

The transformer 17 may include a first coil (T1) which is an input and a second coil (T2) which is an output, that is, a main coil. The transformer 17 may further include an auxiliary coil, that is, a third coil (T3), if necessary.

The first coil terminal (I2) of the transformer 17 is connected with a minus output terminal (BD2) of the rectifier 13. In this process, the switching circuit 14 is insertedly connected between the first coil terminal (I2) of the transformer 17 and the minus output terminal (BD2) of the rectifier 13.

The switching circuit 14 repeats on/off at a predetermined frequency and a duty ratio and it transmits a power to the transformer.

According to the lighting system shown in FIG. 2 as mentioned above, the switching circuit 14 is provided in the driving circuit of the lighting apparatus. Because of that, flickering generated in the LED module 2 because of the varying input voltage of the dimmer 12 may be reduced.

Figure 3:
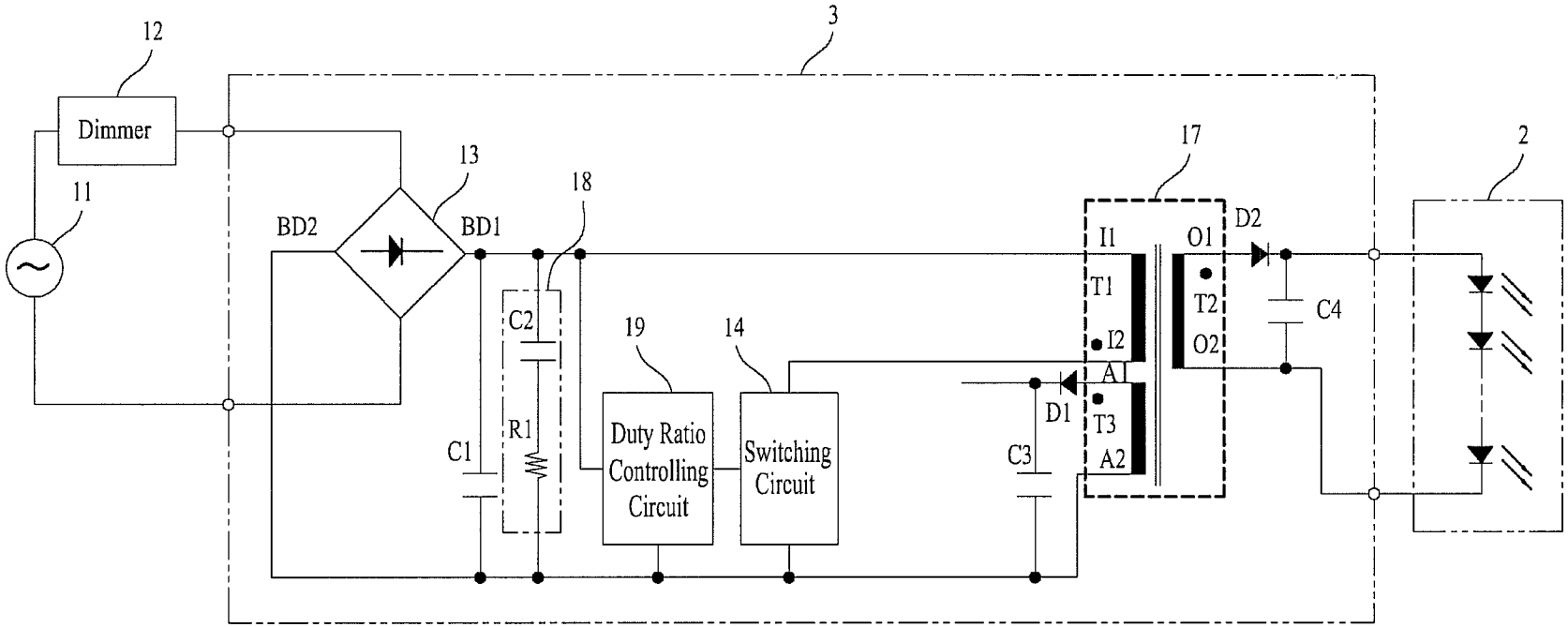
FIG. 3 is a diagram illustrating a lighting system according to another embodiment of the present invention.

FIG. 3 is a diagram illustrating a lighting system according to another embodiment of the present invention.

Here, when describing the lighting system shown in FIG. 3, the same description of this embodiment has to be referenced to as the description made above in reference to FIG. 2 and different description will be made as follows.

Different from the lighting system shown in FIG. 2, the lighting system shown in FIG. 3 represents a driving circuit 3 further including a duty ratio controlling circuit 19 controlling a duty ratio based on a voltage input after rectified by a rectifier 13.

The duty ratio controlling circuit 19 may be connected between a plus output terminal (BD1) and a minus output terminal (BD2) of a rectifier 13, and it may be located at a front end of a switching circuit 14.

The duty ratio controlling circuit 19 determines whether the voltage input via the rectifier 13 is lowered to a predetermined range or less. When currents of a dimmer 12 are lower too much based on the result of the determination, the duty ratio controlling circuit 19 could be cut-off. Because of that, the duty ratio controlling circuit 19 may control the duty ratio of the voltage input to the rectifier 13 to prevent the cut-off which could be generated by the currents lowered by the dimmer 12.

Like FIG. 2, FIG. 3 represents that the duty ratio controlling circuit 19 is provided in the driving circuit 3, together with the switching circuit 14. In case of the low voltage input via a dimmer 12, the duty ratio of the switching circuit 14 may be set and/or controlled for the currents consumed by the driving circuit of the LED module 2 not to be in a predetermined range or lower of the dimmer 12. The predetermined range refers to a low limit at which the dimmer 12 can be operated normally, for example. This is similar to heightening the duty ratio for minimum currents required by the driving circuit in Pulse Width Modulation (PWM) operation.

As a result, the cut-off generated by lowering the currents of the dimmer 12 too much in case of the low input voltage may be prevented according to the present invention.

Figure 4:
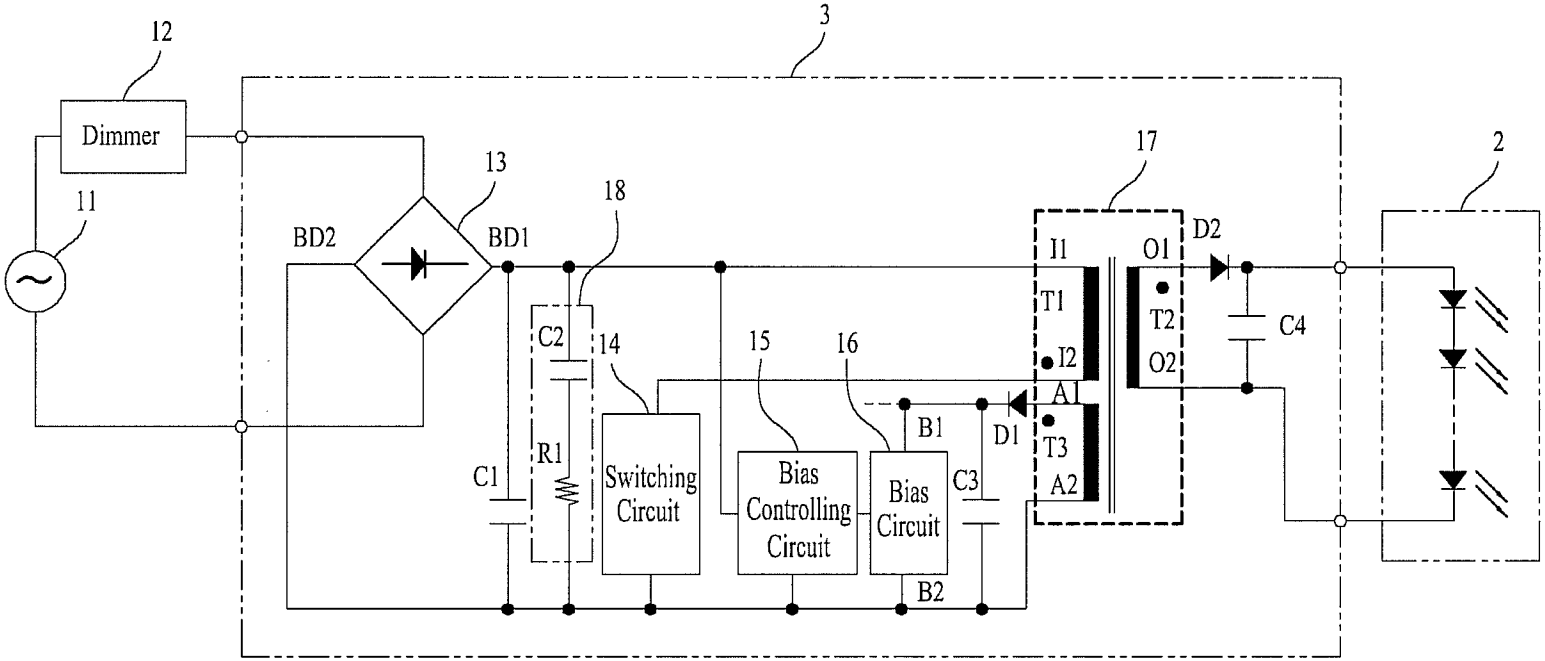
FIG. 4 is a diagram illustrating a lighting system according to a further embodiment of the present invention.

FIG. 4 is a diagram illustrating a lighting system according to a further embodiment of the present invention.

Here, when describing the lighting system shown in FIG. 4, repeated description has to be referenced to the description of FIG. 2 and different description will be made as follows.

Different from the description of FIG. 2, FIG. 4 represents that a driving circuit 3 includes a rectifier 13, a switching circuit 14, a bias controlling circuit 15, bias circuit 16 and a transformer 17, when supplying a power used to drive an LED module 2 located at a rear end by receiving an input commercial AC power varied based on a conduction phase angle controlled by a dimmer 12. Here, the driving circuit 3 may further include a damper circuit 18.

In reference to the accompanying drawings, each part of the driving circuit 3 and a function of each part will be described as follows.

The rectifier 13 receives an input commercial AC power supplied from a power part 11 via a dimmer 12. The rectifier 13 rectifies the input commercial AC power and it converts the commercial AC power into a DC power. At this time, the rectification may be full-wave rectification.

The DC power rectified from the AC power by the rectifier 13 is connected to a first coil terminal (I1) of the transformer 17, a capacitor (C1) and the damper circuit 18.

The transformer 17 includes a first coil (T1) which is an input end, a second coil (T2) which is an output end and a third coil (T3).

The first coil terminal (I2) of the transformer 17 is connected with a minus output terminal (BD2) of the rectifier 13 via the switching circuit 14.

Here, the switching circuit 14 repeats on/off at a predetermined frequency and a predetermined duty ratio and it transmits an electric power to the transformer 17.

The bias controlling part 15 is connected between a plus output terminal (BD1) and the minus output terminal (BD2) of the rectifier 13 and it converts a voltage of the plus output terminal (BD1) of the rectifier 13 into a predetermined voltage which is in proportion to an average, a peak voltage, an ON-phase of the dimmer 12, to output the converted voltage to the bias circuit 16.

The bias circuit 16 rectifies a voltage at a terminal (A1) of the output coil (T3) provided in the transformer 17 at a diode (D1). The bias circuit 16 is connected with a power smoothed by a capacitor (C3) and the minus output terminal (BD2) of the rectifier 13. Because of that, the current of the bias circuit 16 is controlled by the output of the bias controlling circuit 15.

Figure 5:
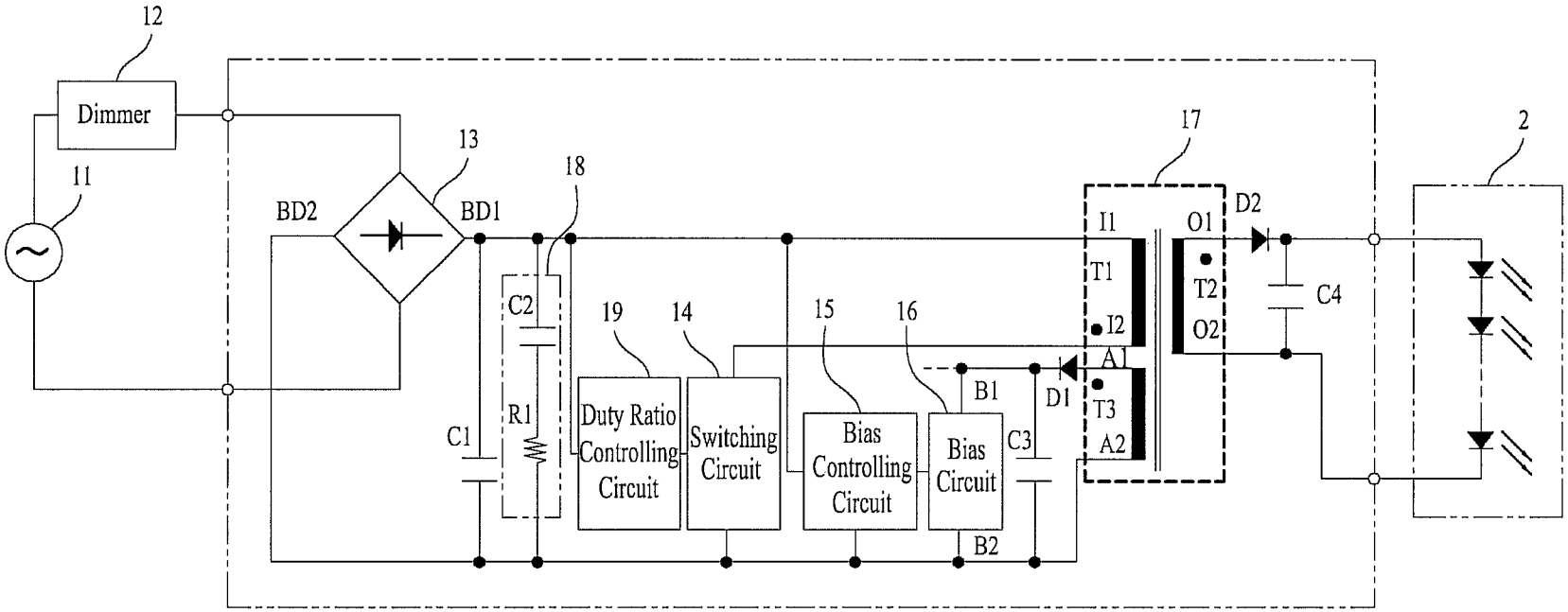
FIG. 5 is a diagram illustrating a lighting system according to a still further embodiment of the present invention.

FIG. 5 is a diagram illustrating a lighting system according to a still further embodiment of the present invention.

Here, when describing the lighting system shown in FIG. 5, repeated description has to be referenced to the description of FIGS. 2 through 4 and different description will be made as follows.

A driving circuit 3 of FIG. 5 includes a bias controlling circuit 15, a bias circuit 16 and a duty ratio controlling circuit 19, different from the driving circuit 3 of FIG. 2. The driving circuit 3 includes a bias controlling circuit 15 and a bias circuit 16, different from the driving circuit 3 of FIG. 3. It includes a duty ratio controlling circuit 19, different from the driving circuit 3 of FIG. 4.

In FIGS. 4 and 5, the bias circuit 16 as switching element receives output of the bias controlling circuit 15 at a negative terminal of a diode (D5) and a positive terminal of the diode (D5) is connected with a base of a first transistor (Q1) and a base resistance (R7). A second transistor (Q2) is Darlington-connected with the first transistor (Q1). Because of that, a base current of the first transistor (Q1) is suppressed to be a relatively small value. An emitter of the second transistor (Q2) is connected with a resistance (R8). A current of the bias circuit 15 is determined by the base voltage of the first transistor (Q1), the voltage between the base and emitter of the first transistor (Q1) and the second transistor (Q2), the power voltage output by rectifying and smoothing the third coil (T3) of the transformer 17 and the resist (R8).

When a conduction phase angle of the dimmer 12 is small, an output voltage average of the rectifier 13 is getting small and the base voltage of the first transistor (Q1) is lowered. In contrast, when the conduction phase angle of the dimmer 12 is large, the output voltage average of the rectifier 13 is getting large. Here, the voltage output by rectifying and smoothing the third coil (T3) of the transformer 17 is almost a predetermined value in proportion to a forward voltage of the LED module 2. Because of that, the current of the bias circuit 16 is reduced as the conduction phase angle of the dimmer 12 is increasing. When an output voltage of the bias controlling circuit 15 is the rectified and smoothed voltage of the third coil (T3) provided in the transformer 17 or more, no currents flow at the bias circuit 16.

A terminal (O1) of the second coil (T2) provided in the transformer 17 may be connected with an anode of a diode (D2). At this time, a cathode of the diode (D2) is connected with a capacitor (C4) and a plus terminal of the LED module 2.

A minus terminal of the LED module 2 is connected with a terminal (O2) of the second coil (T2) of the transformer 17 and a minus terminal of the capacitor (C4).

When the current of the transformer 17 is cut by off of the switching circuit 14, a magnetic energy stored in a core of the transformer 17 is converted into a current. The current is supplied to the LED module 2 via the diode (D2) of the second coil (T2). Together with that, a voltage determined based on a turns ratio is applied to the third coil (T3) by the current to be supplied to the bias circuit 16 and the capacitor (C3) via a diode (D1). The capacitor (C4) smoothes currents flowing in the LED module 2.

In reference to FIGS. 4 and 5, according to the present invention, the switching circuit 14 is operated in CRM with a fixed on-time and it is operated, without cutting off the switching circuit 14 and lowering the duty ratio even in case of the lower input voltage. Because of that, sufficient currents are flowing to operate the dimmer 12 normally.

Under this condition, the input voltage is low. Because of that, the output voltage of the bias controlling circuit 15 which is an average of the input voltage is lowered than the voltage of the terminal (B1) of the bias circuit 16 which is the rectified and smoothed voltage of the third coil (T3) determined to be almost the forward voltage of the LED module 2. As a result, the current determined by the output of the bias controlling circuit 15 and a potential difference of the terminal (B1) of the bias circuit 15 may be supplied to the bias circuit 16 to be consumed. The power supplied to the LED module 2 is lowered as much as the power consumed by the bias circuit 16 and dimming may be suppressed at a lower voltage region.

The control of the bias controlling circuit 15 and the bias circuit 16 may secure stable operation of the simmer 12 and set the current of the LED module 2 at the lower voltage region properly.

Figure 6:
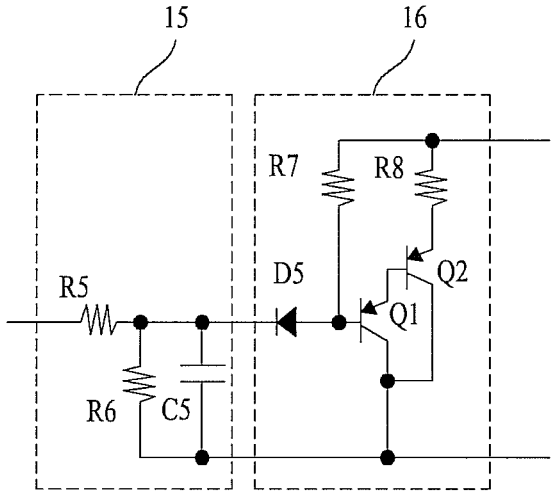
FIG. 6 is a diagram illustrating a bias controlling circuit shown in FIGS. 2 through 5 according to an embodiment and a detailed circuit configuration of the bias circuit.

FIG. 6 is a diagram illustrating a detailed circuit configuration of the bias controlling circuit 15 and the bias circuit 16 shown in FIGS. 2 through 5 according to an embodiment.

In reference to FIG. 6, the bias controlling circuit 15 includes a voltage sensing part for dividing the input voltage and a smoothing part for smoothing the divided voltages to an average voltage. For example, the voltage sensing part divides the input voltage into divided circuits including resistive elements (R5 and R6). The smoothing part smoothes the divided voltages to be a capacitor element (C5). The divided voltages may be converted into an average in the smoothing process. The smoothed average voltage is output to the bias circuit 16.

Figure 7:
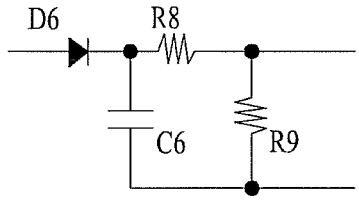
FIG. 7 is a diagram illustrating a circuit configuration of a bias controlling circuit according to another embodiment of the present invention.
Figure 8:
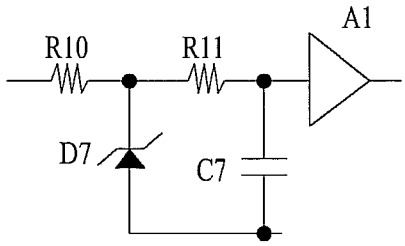
FIG. 8 is a diagram illustrating a circuit configuration of a bias controlling circuit according to a further embodiment of the present invention.

FIG. 7 is a diagram illustrating a circuit configuration of the bias controlling 15 according to another embodiment and FIG. 8 is a diagram illustrating a circuit configuration of the bias controlling circuit 15 according to a further embodiment.

In FIG. 6 described above, the bias controlling circuit 15 is configured to output the voltage in proportion to an average of the voltages output from the rectifier 13.

However, in FIG. 7, the bias controlling circuit 15 may be configured to output a voltage based on a peak voltage of the voltage output from the rectifier 13. In FIG. 8, the bias controlling circuit 15 may be configured to output a voltage in proportion to an on-phase angle of the dimmer 12.

The embodiment of the present invention is realized by embodying a flyback type circuit and the present invention is not limited thereto. The lighting apparatus may be configured based on a buck-type circuit shown in FIG. 9 and a buck-boost type circuit shown in FIGS. 10 and 11.

Figure 9:
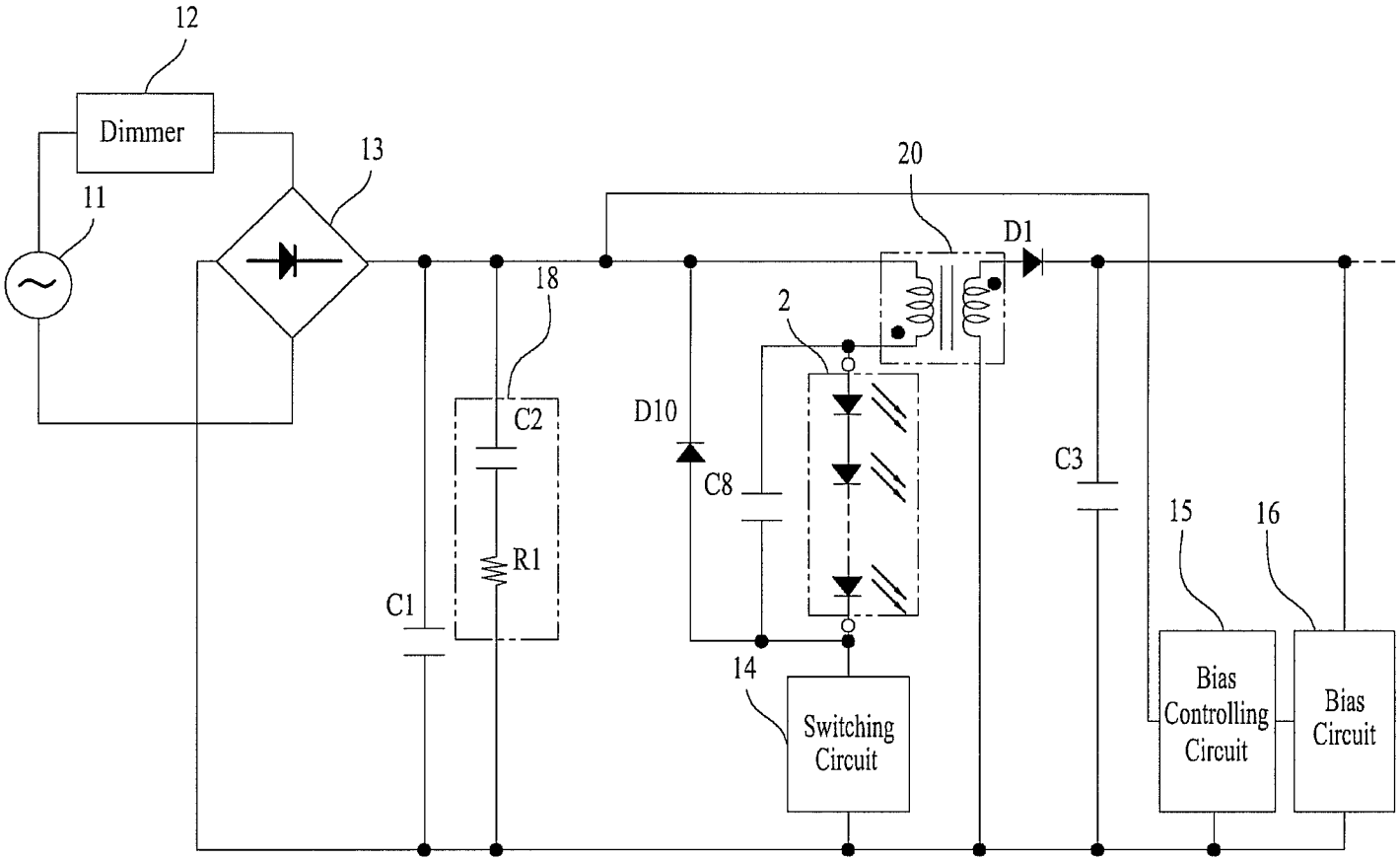
FIG. 9 is a diagram illustrating a buck type lighting system according to an embodiment of the present invention.
Figure 10:
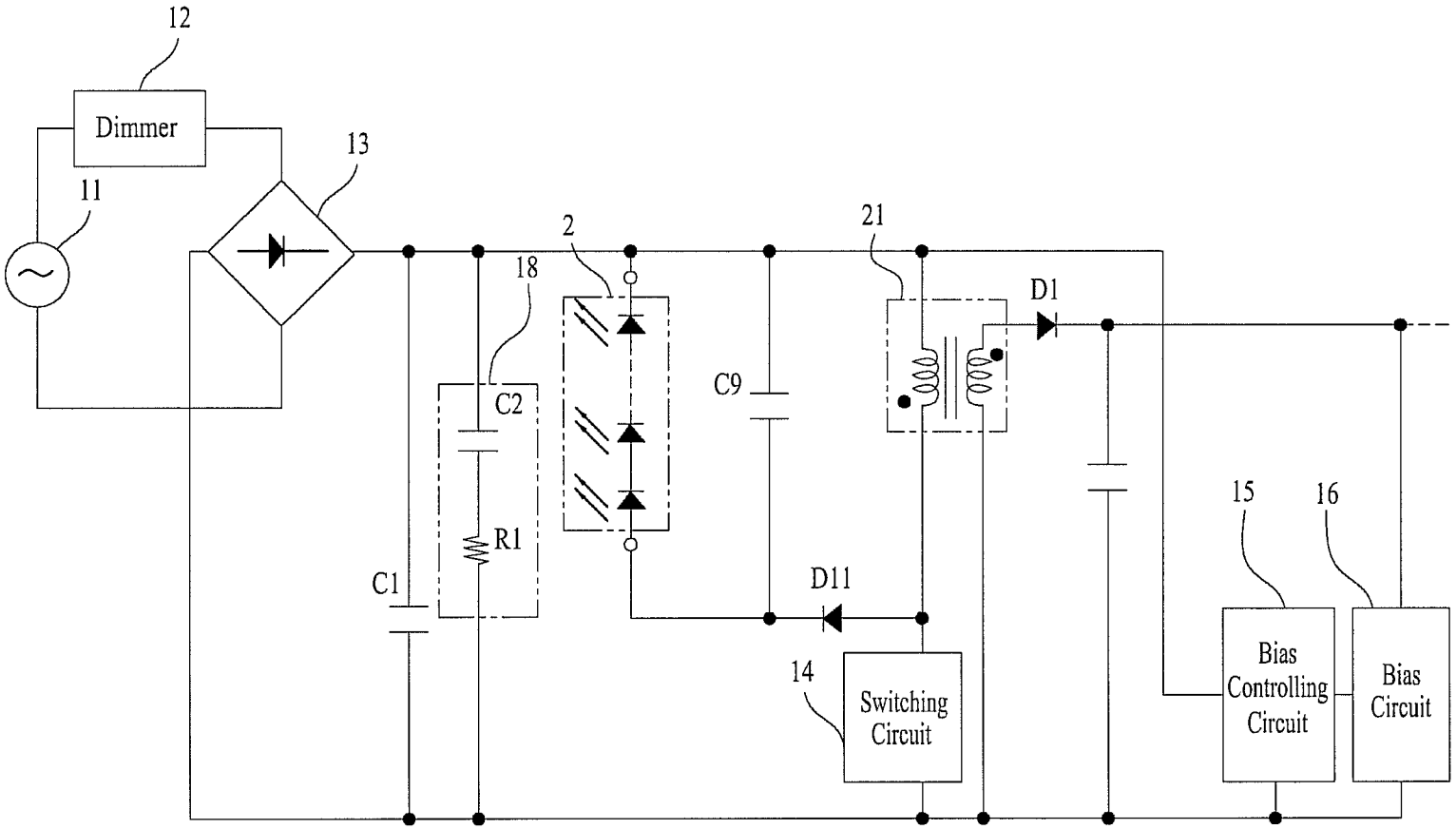
FIGS. 10 and 11 are diagrams illustrating a buck-booster type lighting system according to an embodiment of the present invention.
Figure 11:
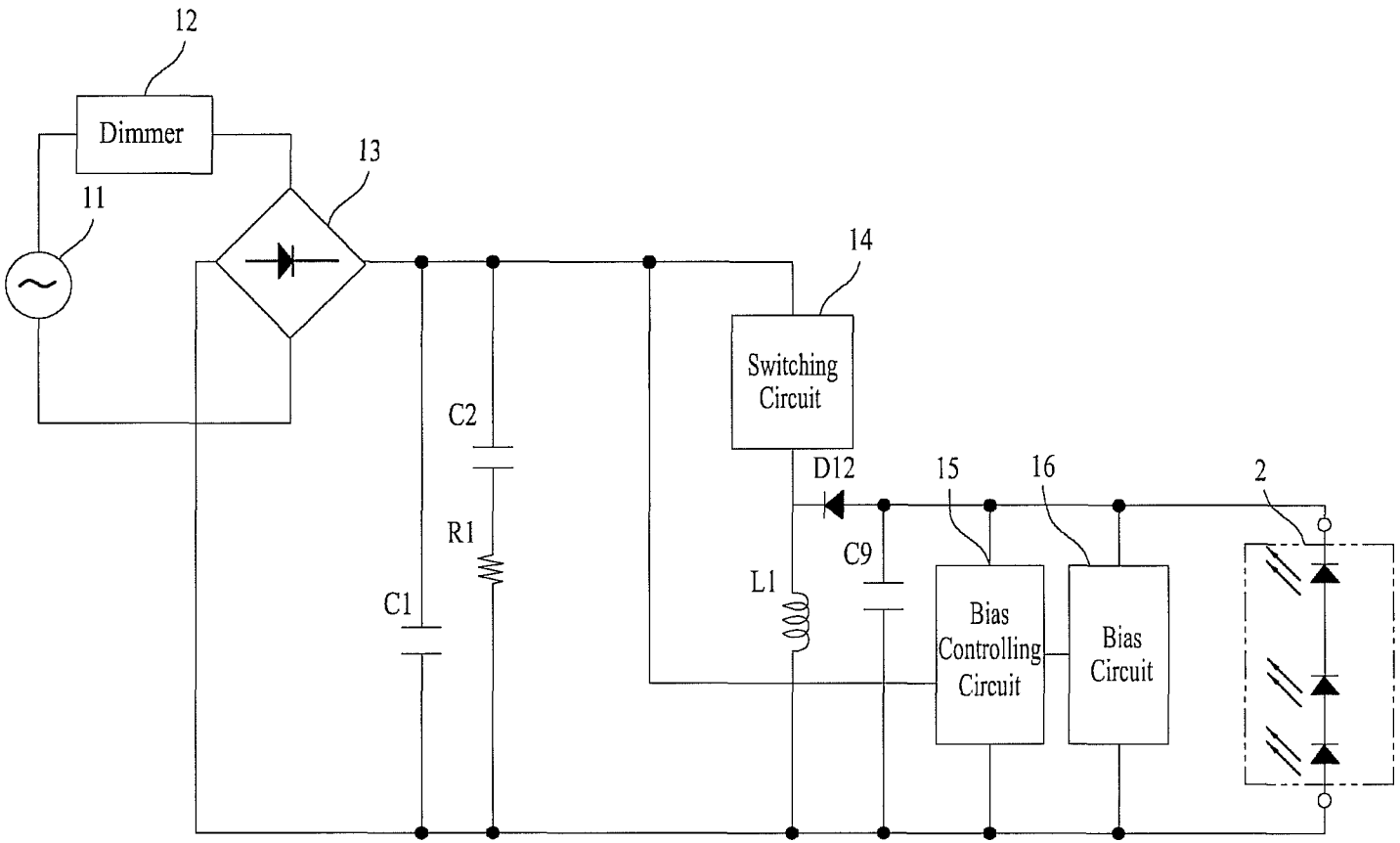

Especially, the present invention is not limited to this embodiment of the lighting apparatus shown in FIGS. 9 through 11 and the other embodiments of the present invention. The LED module, the transformer, the switching circuit, the bias controlling circuit and the bias circuit may be arranged in the lighting system variously, with various types. As a result, relating circuits, elements and a configuration, type or arrangement of the elements may be various.

Figure 12:
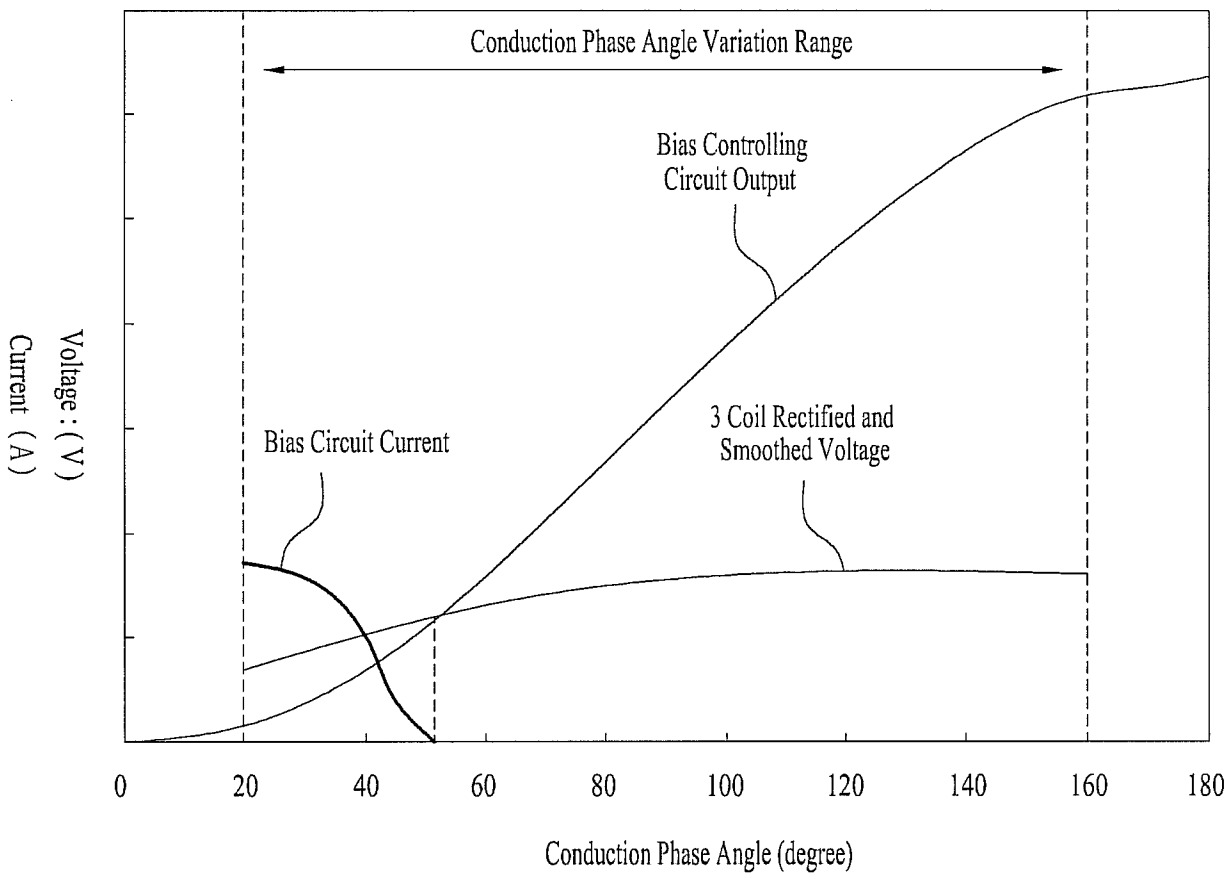
FIG. 12 is a diagram illustrating a relationship among a conduction phase angle of the dimmer, an output voltage of the bias controlling circuit, a voltage rectified and smoothed from a third coil (T3) of a transformer and a bias circuit current according to an embodiment of the present invention.

FIG. 12 is a diagram illustrating a relationship among the conduction phase angle of the dimmer 12, the output voltage of the bias controlling circuit 15, the rectified and smoothed voltage of the third coil (T3) provided in the transformer 17 and the current of the bias circuit according to an embodiment of the present invention.

A lighting control method of the lighting system including the dimmer and the lighting apparatus having the LED module includes a step of controlling and outputting a phase of the AC power input via the dimmer, a step of rectifying the output AC power into a DC power, a step of determining whether the input DC power is lowered to be in a predetermined range or lower, a step of transforming the rectified power and biasing a current used to drive the LED module based on the transformed voltage, and a step of irradiating a light by driving the LED module.

Here, the biasing step may bias the bias current to be varied in reverse proportion to the Ac input voltage or to increase a limit value of the driving voltage for the LED module.

The biasing step may use one of the average of waveforms used to rectify the input AC voltage, the peak voltage and the phase angle allowing the dimmer to be on.

The lighting control method may further include a step of adjusting a duty ratio of the rectified power by repeating On/Off at a predetermined frequency and a predetermined duty ratio.

The step of determining whether the AC input voltage is lowered to be in the predetermined range or less may set and control the rectified power to lower the duty ratio in a range generating no interruption of the AC line currents, when the AC input voltage is lowered to be in the predetermined range or less based on the result of the determination.

Alternatively, the step of determining whether the AC input voltage is lowered to be in the predetermined range or less controls the output to be lowered by connecting the power line after the rectification with the ground and it controls the duty ratio of the rectified power not to be adjusted, when the AC input voltage is lowered to be in the determined range or less based on the result of the determination.

A conduction phase angle control range of the dimmer 12 is limited by the used TRIAC element. Generally, the lowest dimming phase of the output voltage is approximately 160 degrees. At this time, a peak value of the output voltage of the rectifier 13 is $\sqrt{2}V$ sin 160 deg with respect to an effective voltage (V) of the commercial power. When the commercial power is 100V, the peak value is 48V. In case of the conventional incandescent lamp, an input voltage is low under this condition and the temperature of the filament is lowered to deteriorate light-emitting efficiency. Because of that, the incandescent lamp is on and off quite dark.

In contrast, light-emitting efficiency of the LED is not deteriorated even when the current is lowered. Because of that, even if the power is lowered at the same ratio as the incandescent lamp, a lowering ratio of brightness is relatively small in comparison to the incandescent lamp.

Therefore, as mentioned above, the dimmer is controlled to operate normally in the lighting system having the LED as lighting source according to the present invention. Because of that, the lighting may be controlled by using the dimmer and the flickering generated in the lighting apparatus by the input voltages or power consumption may be reduced. As mentioned above, sufficiency currents to operate the phase control dimmer normally may be flowing at a lower input voltage region according to the present invention. Because of that, the flickering which might be generated in the combining process between the LED lighting apparatus and the phase control dimmer may be reduced or the current bias circuit is controlled to vary the currents in reverse proportion to the input voltages. No bias circuit currents may be flow at the high input voltage region or the non-light irradiating region, to reduce power consumption.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A lighting apparatus comprising:

a light emitting diode (LED) module;

a heat sink configured to emit heat from the LED module;

a rectifier configured to rectify an input alternative current (AC) power;

a transformer including a first coil and a second coil to transform the rectified power;

an electronic module configured to bias a current for operating the LED module based on an input power transformed from the second coil;

a switching circuit configured to repeat on and off based on a predetermined frequency and a duty ratio and adjust a duty ratio; and a damper part configured to decrease the output based on the input voltage automatically, wherein the electronic module biases the current to be varied in reverse proportion to the AC input power, and wherein, when the AC input voltage is lowered, the lighting apparatus sets and controls an on-time of the switching circuit to be reduced below a range in which interruption of AC line currents is not generated and controls to lower the output of the damper part to be connected to a rower line after the rectifying with a ground.

2. The lighting apparatus of claim 1, wherein the electronic module biases to heighten a limited value of a voltage for operating the LED module in reverse proportion to the input AC power.

3. The lighting apparatus of claim 1, wherein the electronic module biases the current for operating the LED module based on an average of waveforms rectifying the AC input power.

4. The lighting apparatus of claim 1, wherein the electronic module biases the current for operating the LED module based on a peak voltage of waveforms rectifying the AC input power.

5. The lighting apparatus of claim 1, wherein the electronic module biases the current for operating the LED module based on a phase angle at which a dimmer controlling dimming of the lighting apparatus is on.

6. The lighting apparatus of claim 1 wherein, when the AC input voltage is lowered, the lighting apparatus controls to lower the output of the damper part to be connected the power line after the rectifying with the ground, and does not control a duty ratio of the on-time of the switching circuit.

7. A method of controlling a light in a lighting system including a lighting apparatus having a light emitting module (LED) and a dimmer, the method comprising:

controlling and outputting a phase of an alternative current (AC) power input via the dimmer;

rectifying the output AC power into a direct current (DC) power;

determining whether the rectified input power is lowered to be in a predetermined range or lower;

adjusting a duty ratio of the rectified power at a predetermined frequency and a predetermined duty ratio;

transforming the rectified input power;

biasing a current used to operate the LED module based on the transformed power; and radiating a light by operating the LED module, wherein the biasing step biases the current to be varied in reverse proportion to the AC input power, and wherein the step of determining whether the AC input voltage is lowered to be in a predetermined range or less sets and controls the rectified power to lower the duty ratio in a range generating of the AC line currents when the AC input voltage is lowered to be in the predetermined range or less based on the result of the determination.

8. The method of claim 7, wherein the biasing step biases the current to increase a limit value of an operating voltage for the LED module.

9. The method of claim 8, wherein the biasing step uses one of the average of waveforms used to rectify the input AC input power, a peak voltage and a phase angle allowing the dimmer to be on.

10. A method of controlling a light in a lighting system including a lighting apparatus having a light emitting module (LED) and a dimmer, the method comprising:

controlling and outputting a phase of an alternative current (AC) power input via the dimmer;

rectifying the output AC power into a direct current (DC) power;

determining whether the rectified input power is lowered to be in a predetermined range or lower;

adjusting a duty ratio of the rectified power by repeating on/off of a switching circuit at a predetermined frequency and a predetermined duty ratio;

transforming the rectified input power;

biasing a current used to operate the LED module based on the transformed power; and radiating a light by operating the LED module, wherein the step of determining whether the AC input voltage is lowered to be in a predetermined range or less controls the output to be lowered by connecting the power line after the rectification with the ground and controls the duty ratio of the rectified power not to be adjusted, when the AC input voltage is lowered to be in the determined range or less based on the result of the determination.

* * * * *